United States Patent [19]

Tourtillott

[11] Patent Number: 4,973,950

[45] Date of Patent: Nov. 27, 1990

[54] SEWER BLOCKAGE ALARM

[76] Inventor: Robert Tourtillott, 745 S. Marias, Clawson, Mich. 48017

[21] Appl. No.: 455,551

[22] Filed: Dec. 4, 1989

[51] Int. Cl.[5] ..... G08B 21/00

[52] U.S. Cl. ..... 340/608; 340/626

[58] Field of Search ..... 340/603, 607, 608, 611–616, 340/626; 73/756; 200/61.2

[56] References Cited

U.S. PATENT DOCUMENTS

| | | | |
|---|---|---|---|
| 2,761,037 | 8/1956 | Thomas et al. | 340/608 X |
| 3,774,187 | 11/1973 | Windham | 340/608 |
| 4,546,346 | 10/1985 | Wave et al. | 340/616 X |

*Primary Examiner*—Joseph A. Orsino
*Assistant Examiner*—Jeffery A. Hofsass
*Attorney, Agent, or Firm*—John R. Benefiel

[57] ABSTRACT

A sewer blockage alarm for a sewer line having a pressure sensor mounted at the top of a clean out branch section of the sewer line which is connected to a large diameter pressure multiplying pressure bell via a length of flexible to be dangled at the entrance of the branch section. An audible and a visual indicator are activated by slight pressure rises caused by water level rising to the tip of sewer line to provide an early warning of an incipient blockage condition.

4 Claims, 1 Drawing Sheet

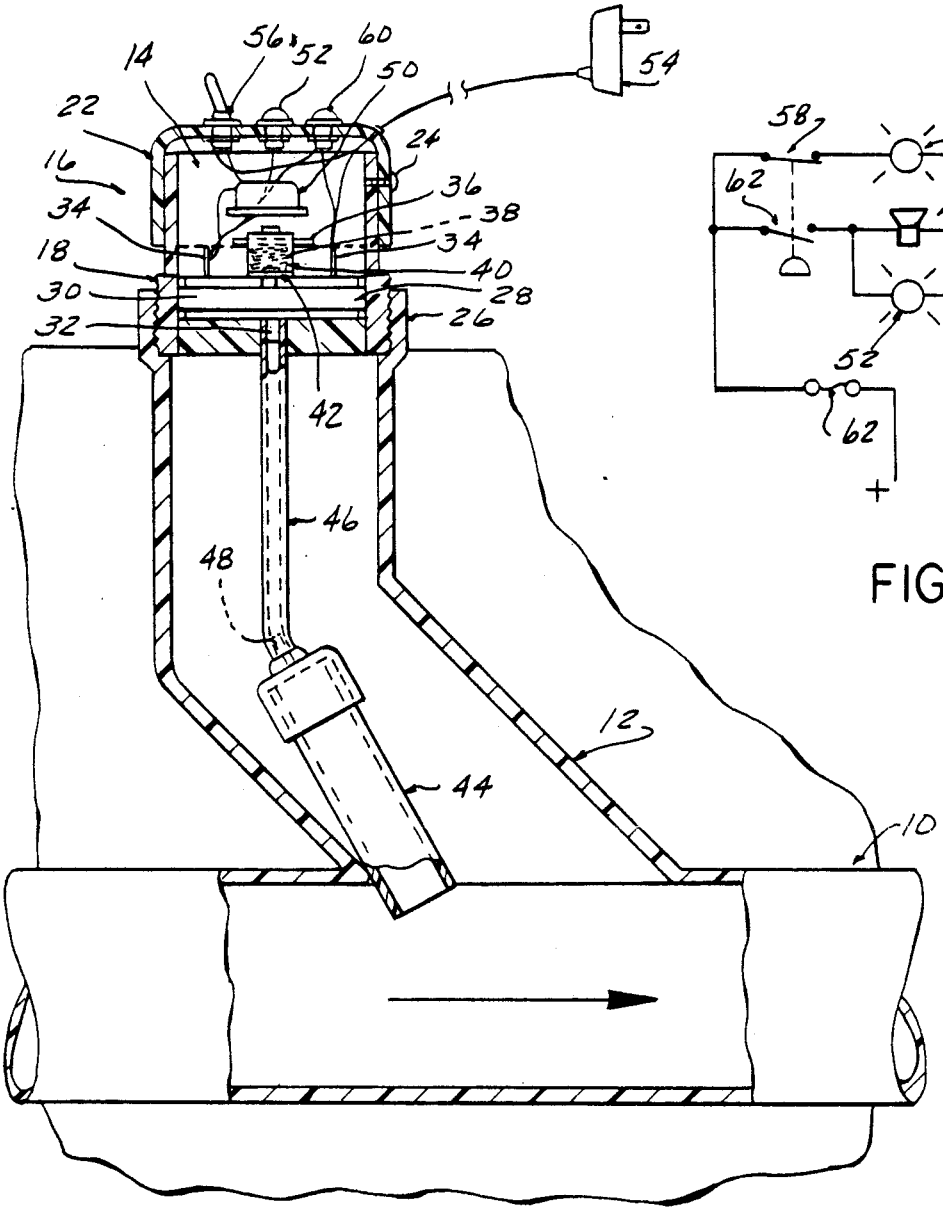
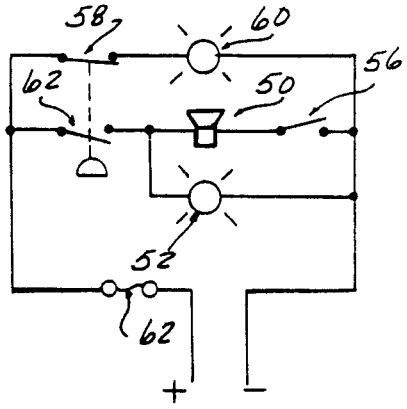
FIG-2
FIG-1

SEWER BLOCKAGE ALARM

BACKGROUND OF THE INVENTION

1. Field of the Invention

This invention concerns sewer back up alarms particularly usable with residential plumbing systems to give early notice of a blocked sewer condition to avoid a backup into the house.

It has long been recognized that a simple and reliable alarm would be highly desirable, and many devices have heretofore been proposed in the prior art.

However, a practical, completely acceptable device has yet to be introduced.

A sewer cap having a built in water sensor is described in U.S. Pat. No. 4,392,128. This device utilized electrical sensors which sense when water rises into an adaptor. The location of the sensor is such that the blockage must have caused the water level to rise into the adaptor to trigger an alarm, at which point it may be too late to prevent flooding. Also, the use of electrical conductors requires that they be kept clean so that the water rise may reliably set off the alarm.

U.S. Pat. No. 3,757,316 shows a similar device which optionally uses a float.

Floats have the additional disadvantage of being subject to mechanical failure and are more difficult to install into a sewer line.

U.S. Pat. Nos. 3,774,187, 4,398,186 and 4,091,365 also show float operated devices.

U.S. Pat. No. 4,546,346 describes a back up alarm which uses a built in pressure switch activated by a pressure rise generated by a back up in the sewer line.

This device depends on an air tight sealing of the threads on the cap, which is not always achieved, to compromise the reliability of the design. Again, the water level may have to rise into the branch to an appreciable height to trigger the alarm.

SUMMARY OF THE INVENTION

The present invention comprises a sewer blockage alarm comprised of a pressure sensor switch mounted to the inside of a cap for a sewer clean out branch. An open ended pressure bell is connected to the pressure sensor by a length of a trimmable flexible tubing to enable ready installation of the bottom of the pressure bell at a height just above the main sewer run. This enables reliable detection of a sewer blockage by a pressure sensor at the earliest point without the necessity of insuring an air tight sealing of the cap threads. The tubing may be trimmed to easily enable positioning of the bell properly for each field condition of a sewer cleanout.

BRIEF DESCRIPTION OF THE DRAWINGS

FIG. 1 is a sectional elevational view of a sewer line with a clean out branch having the sewer alarm according to the present invention installed therein.

FIG. 2 is a schematic diagram of the electrical circuit associated therewith.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

FIG. 1 shows a sewer line 10 having a cleanout branch 12 extending upwardly at an angle therefrom.

A sewer alarm device 14 is contained within a housing 16 which may be constructed from a threaded plug 18, a short pipe section 20 attached, and a cap 22 received over the upper end of the pipe section 20 and secured thereon as with screws 24. This construction enables the housing 16 to be threaded into the female fitting 26 of the cleanout branch 12 as shown for convenient installation.

The alarm device 14 includes a pressure sensor unit 28, which may be of a commercially available type including a sealed housing 30 having a port tube 32 extending from one side communicating with an internal chamber sensitive to a pressure to be measured. Electrical terminals 34 project from the other side of the sensor housing 30, and are electrically connected upon sensing a predetermined pressure in port tube 32.

Such devices are well known and typically include a movable diaphragm operating the electrical contacts 34.

Since such devices are well known, the details are not here described.

The triggering pressure level is made adjustable by rotation of a thumb wheel 36 threaded on a pin 38 to increase or decrease the countering pressure of a spring 40 acting on a button 42 connected to the sensor diaphragm (not shown).

According to the concept of the present invention, an open ended pressure bell 44 is connected to the sensor 28 by means of a flexible extension tube 46 received over the port tube 32 at one end and a nipple 48 extending from the closed end of the pressure bell 44.

The pressure bell 44 is of a much larger diameter than tube 46 and port tube 32, to multiply the pressure changes exerted by water rising to the level of the open end of the pressure bell so as to produce reliable triggering of the sensor 38 by the relatively modest pressure exerted by relatively small rises of water level in the sewer line 10 to the level of the entrance to the branch 12.

The electrical terminals 34 control the application of power to an audible alarm buzzer 50 and signal light 52 mounted atop the cap 22, from a source of power, such as an AC adaptor plug 54 inserted in an electrical outlet.

An alarm turn off switch 56 enables manual turn off of the audible alarm 50.

The circuit is shown schematically in FIG. 2. A normally closed contact 58 lights a power indicator light 60 whenever power is on.

A pressure level triggered contact set 62 included in the sensor 28 is normally open but closed when the predetermined pressure is exerted at port tube 32. This energizes the buzzer 50 and alarm light 52. The manual switch 56 allows shut off of the buzzer after triggering of the blockage alarm has been noted.

A fuse 64 may also be included.

The combination of the pressure sensor with the extension tube 46 and pressure bell 44 allows the initial water level rise indicating an incipient blockage condition to be reliably detected. This combination can be easily custom fit to widely varying field conditions and sewer line configurations. The extension tube may be cut to position the open end of the bell 44 at just the right level for early triggering of the alarm. The bell 44 acts as a weight to reliably position its closed end at the entrance to the upwardly extending cleanout branch 12.

The pressure sensor does not depend on air tight sealing of the threads, the pressure bell 44 providing a self contained system which is easily tailored to any field plumbing configuration.

I claim:

1. A sewer blockage alarm for detecting a blockage in a sewer line at an upwardly extending branch section of said sewer line, said alarm comprising:

an alarm housing mounted in the upper end of said branch section;

a pressure sensing device mounted in said alarm housing including means for completing an electrical circuit upon detection of a predetermined pressure level at a sensor port also included in said pressure sensing device;

an electrically operated indicator device;

an electrical power circuit associated with said pressure sensing device and said indicator device causing energization thereof upon sensing of said predetermined pressure level at said port;

a pressure bell comprising a substantially rigid tube having an interior space of much larger cross-sectional area than said sensing port and completely open at one end and having a substantially smaller diameter nipple at the end of said tube opposite said completely open end, said nipple communicating with the interior space; and a length of flexible tubing connected at one end to said sensor port and at the other end to said pressure bell by being fit over said nipple, whereby said pressure bell hangs down into said sewer branch section to position the completely open end of said pressure bell at the entrance to said branch section.

2. The sewer blockage alarm according to claim 1 wherein said indicator comprises a electrical light and audible alarm and wherein said electrical circuit means further includes a manual switch for independently cutting off said audible alarm.

3. The sewer blockage alarm according to claim 1 wherein said alarm housing includes a threaded section adapted to be fit into a threaded female fitting included o n said sewer branch section.

4. The sewer blockage alarm according to claim 1 wherein said pressure bell comprises a length of round tubing of a substantially large diameter than said flexible tubing.

* * * * *